US010359194B2

(12) United States Patent
Schilp et al.

(10) Patent No.: US 10,359,194 B2
(45) Date of Patent: Jul. 23, 2019

(54) FILM COOLING HOLE ARRANGEMENT FOR ACOUSTIC RESONATORS IN GAS TURBINE ENGINES

(71) Applicant: Siemens Energy, Inc., Orlando, FL (US)

(72) Inventors: Reinhard Schilp, Winter Park, FL (US); Timothy A. Fox, Hamilton (CA)

(73) Assignee: SIEMENS ENERGY, INC., Orlando, FL (US)

( * ) Notice: Subject to any disclaimer, the term of this patent is extended or adjusted under 35 U.S.C. 154(b) by 327 days.

(21) Appl. No.: 15/502,016

(22) PCT Filed: Aug. 26, 2014

(86) PCT No.: PCT/US2014/052598
§ 371 (c)(1),
(2) Date: Feb. 6, 2017

(87) PCT Pub. No.: WO2016/032434
PCT Pub. Date: Mar. 3, 2016

(65) Prior Publication Data

US 2017/0227220 A1 Aug. 10, 2017

(51) Int. Cl.
*F23R 3/00* (2006.01)
*F23R 3/06* (2006.01)

(52) U.S. Cl.
CPC ..... *F23R 3/002* (2013.01); *F23R 3/06* (2013.01); *F23R 2900/00014* (2013.01); *F23R 2900/03044* (2013.01)

(58) Field of Classification Search
CPC .. F23R 3/002; F23R 3/06; F23R 2900/00014; F05D 2260/963; F01N 1/02
(Continued)

(56) References Cited

U.S. PATENT DOCUMENTS

RE22,998 E * 5/1948 Kronmiller ..... H01H 37/52 337/335
2,588,728 A 3/1952 Hundstad
(Continued)

FOREIGN PATENT DOCUMENTS

CN 87101982 A 10/1987
CN 101539294 A 9/2009
(Continued)

OTHER PUBLICATIONS

PCT International Search Report and Written Opinion dated Apr. 30, 2015 corresponding to PCT Application No. PCT/US2014/052598 filed Aug. 26, 2014.

*Primary Examiner* — Todd E Manahan
*Assistant Examiner* — Eric W Linderman

(57) ABSTRACT

The present disclosure provides a gas turbine combustor liner (34) comprising an outer surface (38) and an inner surface (36), a plurality of film cooling holes (44) through a thickness of the gas turbine combustor liner (34), and a plurality of resonator boxes (32) affixed to the outer surface (38) of the gas turbine combustor liner (34). The film cooling holes (44) extend circumferentially around the gas turbine combustor liner (34) and comprise a first set of holes (56) having a first axial row spacing X and a second set of holes (58) having a second axial row spacing X'. The second set of holes (58) is formed in the gas turbine combustor liner (34) in a downstream direction relative to the first set of holes (56). The second axial row spacing X' is greater than the first axial row spacing X.

16 Claims, 7 Drawing Sheets

(58) Field of Classification Search
USPC ..... 60/725
See application file for complete search history.

(56) References Cited

U.S. PATENT DOCUMENTS 3,872,664 A 3/1975 Lohmann et al.
3,899,882 A 8/1975 Parker
3,995,422 A 12/1976 Stamm
4,106,587 A * 8/1978 Nash ..... F02K 1/827 181/213
4,184,326 A 1/1980 Pane, Jr. et al.
4,259,842 A 4/1981 Koshoffer et al.
4,329,848 A 5/1982 Caruel et al.
4,485,630 A 12/1984 Kenworthy
4,655,044 A 4/1987 Dierberger et al.
4,705,455 A 11/1987 Sahm et al.
4,821,387 A 4/1989 Bouillot et al.
5,181,379 A 1/1993 Wakeman et al.
5,261,223 A 11/1993 Foltz
5,361,828 A 11/1994 Lee et al.
5,609,030 A 3/1997 Althaus
5,626,017 A 5/1997 Sattelmayer
5,766,000 A 6/1998 Thompson
5,826,431 A 10/1998 Makino et al.
6,205,789 B1 3/2001 Patterson et al.
6,408,629 B1 6/2002 Harris et al.
6,494,044 B1 12/2002 Bland
6,526,756 B2 3/2003 Johnson et al.
6,530,221 B1 * 3/2003 Sattinger ..... F01D 25/30 181/213
6,640,544 B2 * 11/2003 Suenaga ..... F23M 20/005 181/213
6,675,582 B2 1/2004 Monty et al.
6,837,051 B2 * 1/2005 Mandai ..... F23R 3/005 60/725
6,886,973 B2 5/2005 Phillips
6,983,586 B2 * 1/2006 Tangirala ..... F02K 3/08 60/226.1
7,080,515 B2 7/2006 Wasif et al.
7,246,493 B2 7/2007 Flohr et al.
7,386,980 B2 6/2008 Green et al.
7,413,053 B2 * 8/2008 Wasif ..... F23M 20/005 181/210
7,549,290 B2 * 6/2009 Holt ..... F23M 5/085 431/114
7,788,926 B2 * 9/2010 Johnson ..... F23R 3/286 181/210
7,832,211 B2 * 11/2010 Ikeda ..... F23R 3/04 431/114
7,856,830 B2 12/2010 Alkabie
8,146,364 B2 * 4/2012 Johnson ..... F23R 3/002 431/114
8,469,141 B2 * 6/2013 Wang ..... F23R 3/002 181/212
8,720,204 B2 * 5/2014 Schilp ..... F23R 3/002 181/213
8,973,365 B2 * 3/2015 Corr ..... F23R 3/002 181/207
8,991,185 B2 * 3/2015 Huber ..... F23R 3/002 60/725
9,163,837 B2 * 10/2015 Sutcu ..... F23R 3/10
9,546,558 B2 * 1/2017 Lee ..... F01D 9/023
2004/0248053 A1 * 12/2004 Benz ..... F23R 3/002 431/114
2005/0034918 A1 * 2/2005 Bland ..... F23M 20/005 181/250
2005/0097890 A1 * 5/2005 Ikeda ..... F23R 3/002 60/748
2005/0284690 A1 * 12/2005 Proscia ..... F02C 7/045 181/214
2007/0012048 A1 1/2007 Buret et al.
2007/0209366 A1 9/2007 Gerendas et al.
2008/0041058 A1 2/2008 Johnson et al.
2009/0067998 A1 3/2009 Beck et al.
2009/0094985 A1 4/2009 Johnson et al.
2009/0277180 A1 * 11/2009 Lam ..... F23R 3/002 60/752
2010/0186411 A1 * 7/2010 Matsuyama ..... F01D 9/023 60/725
2011/0091829 A1 4/2011 Barve et al.
2011/0138812 A1 * 6/2011 Johnson ..... F23R 3/00 60/725
2011/0220433 A1 * 9/2011 Nakamura ..... F01D 9/023 181/213
2011/0302924 A1 12/2011 Lee et al.
2012/0073305 A1 3/2012 Knöpfel et al.
2013/0000309 A1 1/2013 Dierberger
2013/0074501 A1 * 3/2013 Tiwary ..... F23M 5/00 60/725
2013/0206500 A1 * 8/2013 Ono ..... F02C 7/24 181/213
2013/0327057 A1 12/2013 Cunha et al.
2014/0345282 A1 * 11/2014 Pfadler ..... F23R 3/002 60/725
2015/0020498 A1 * 1/2015 Schilp ..... F23R 3/002 60/39.83
2015/0082794 A1 * 3/2015 Schilp ..... F01D 9/023 60/722
2015/0159878 A1 * 6/2015 Schildmacher ..... F23R 3/58 60/776
2015/0233580 A1 * 8/2015 Olsen ..... F04D 29/321 60/725
2017/0268777 A1 * 9/2017 Hase ..... F23R 3/002
2017/0276350 A1 * 9/2017 Schilp ..... F23R 3/002
2018/0224123 A1 * 8/2018 Hase ..... F23R 3/002

FOREIGN PATENT DOCUMENTS

CN 101799157 A 8/2010
CN 102242934 A 11/2011
CN 103032890 A 4/2013
JP 2005076982 A 3/2005
JP 2006242561 A 9/2006
JP 20105026274 A 7/2010
JP 2013019567 A 1/2013
WO 0225174 A1 3/2002
WO 20130077394 A1 11/2011
WO 2013029984 A2 3/2013

* cited by examiner

FILM COOLING HOLE ARRANGEMENT FOR ACOUSTIC RESONATORS IN GAS TURBINE ENGINES

FIELD OF THE INVENTION

The present invention relates to gas turbine engines and, more particularly, to cooling a combustor liner in a gas turbine engine.

BACKGROUND OF THE INVENTION

In turbine engines, compressed air discharged from a compressor section and fuel introduced from a source of fuel are mixed together and burned in a combustion section, creating combustion products defining hot combustion gases. The combustion gases are directed through a hot gas path in a turbine section, where they expand to provide rotation of a turbine rotor. The turbine rotor is linked to a shaft to power the compressor section and may be linked to an electric generator to produce electricity in the generator.

One or more conduits such as combustor liners are typically used for conveying the combustion gases from one or more combustor assemblies located in the combustion section to the turbine section. Due to the high temperature of the combustion gases, the combustor liner typically requires cooling during operation of the engine to avoid overheating. Prior art solutions for cooling include supplying a cooling fluid, such as air that is bled off from the compressor section, onto an outer surface of the combustor liner to provide direct convection cooling. An impingement member or impingement sleeve may be provided about the outer surface of the liner, wherein the cooling fluid may flow through small holes formed in the impingement member before being introduced onto the outer surface of the liner. Other prior art solutions inject a small amount of cooling fluid along an inner surface of the liner to provide film cooling to the inner surface.

Damping devices such as resonator boxes may be used to suppress or absorb acoustic energy generated during engine operation. Conventional configurations utilize a combustor liner with acoustic metering holes arranged in a uniform, evenly spaced pattern that equalizes the axial and circumferential distance between each hole. For example, metering holes organized in a rectangular and or axially staggered rectangular pattern can provide an acoustic path between an interior of the resonator boxes and a combustion chamber surrounded by the combustor liner, as well as provide a path for cooling air to cool the combustor liner in an area of the resonator boxes.

SUMMARY OF THE INVENTION

In accordance with one aspect of the invention, the present disclosure provides a gas turbine combustor liner comprising an outer surface and an inner surface, a plurality of film cooling holes through a thickness of the gas turbine combustor liner, and a plurality of resonator boxes affixed to the outer surface of the gas turbine combustor liner. The outer surface of the gas turbine combustor liner is exposed to a cooling airflow and the inner surface is exposed to hot combustion gases. The film cooling holes extend circumferentially around the gas turbine combustor liner and comprise a first set of holes having a first axial row spacing X and being defined by a first plurality of rows of holes extending in a circumferential direction and a second set of holes having a second axial row spacing X' and being defined by a second plurality of rows of holes extending in a circumferential direction. The second set of holes is formed in the gas turbine combustor liner in a downstream direction relative to the first set of holes. The second axial row spacing X' is greater than the first axial row spacing X.

In accordance with other aspects, an axis of the film cooling holes may be substantially perpendicular to the outer surface and the inner surface of the gas turbine combustor liner. In accordance with additional aspects, a dimensionless first axial row spacing, $X_0=X/d$, of the first set of holes may be greater than or equal to about 3 and less than 10, where d is the diameter of the holes, and a dimensionless second axial row spacing, $X_0'=X'/d$, of the second set of holes may be between about 3 and 10. In accordance with another aspect, each of the resonator boxes may extend axially over at least a portion of each of the first set of holes and the second set of holes.

In accordance with a further aspect, the resonator boxes may further comprise a plurality of impingement holes configured to introduce at least a portion of the cooling airflow into the resonator boxes. In a particular aspect, the resonator boxes may further comprise an upstream wall and a downstream wall, in which an upstream wall height may be less than a downstream wall height. In accordance with additional aspects, the resonator boxes may be affixed to a location of the gas turbine combustor liner wherein a flow temperature of the hot combustion gases is increasing in a downstream direction. In accordance with yet further aspects, the first set of holes may further comprise a first circumferential hole spacing and the second set of holes may further comprise a second circumferential hole spacing, with the first circumferential hole spacing being different than the second circumferential hole spacing.

In accordance with another aspect of the invention, the present disclosure provides a turbine engine assembly comprising a turbine engine having a compressor section, a combustor comprising a combustor liner, and a turbine section, and a plurality of resonator boxes affixed to and located circumferentially about an outer surface of the combustor liner. The combustor liner comprises a plurality of film cooling holes extending circumferentially around the combustor liner and extending through a thickness of the combustor liner. The film cooling holes comprise a first set of holes having a first axial row spacing X and a second set of holes having a second axial row spacing X'. The first set of holes and the second set of holes are each defined by a plurality of rows of holes extending in a circumferential direction, with the second set of holes being located in a downstream direction relative to the first set of holes. The second axial row spacing X' is greater than the first axial row spacing X. Each of the resonator boxes extend axially over at least a portion of each of the first set of holes and the second set of holes. The resonator boxes further comprise a plurality of impingement holes configured to introduce a cooling airflow into the resonator boxes.

In accordance with one aspect, the impingement holes may be offset from the film cooling holes. In accordance with a further aspect, an interior of each resonator box may be in fluid communication with an interior of the combustor. In a particular aspect, the resonator boxes may further comprise an upstream wall and a downstream wall, in which an upstream wall height may be less than a downstream wall height.

In accordance with a further aspect of the invention, the present disclosure provides methods for providing film cooling to a combustor liner. In one aspect, the method comprises the steps of: providing a combustor liner comprising a plurality of film cooling holes through a thickness of the combustor liner and a plurality of resonator boxes affixed to and enclosing a portion of an outer surface of the combustor liner; supplying cooling air to the combustor liner in which at least a portion of the cooling air enters a plurality of impingement holes in each resonator box; and flowing the cooling air from the resonator boxes to an interior of the combustor liner such that an airflow through the combustor liner is greatest at an upstream end of the resonator boxes. The resonator boxes extend axially over a portion of the film cooling holes, and entry of the cooling air into the impingement holes in each resonator provides impingement cooling of the portion of the outer surface of the combustor liner enclosed by the resonator boxes.

In accordance with another aspect, the method may further comprise providing a film cooling boundary layer of maximum thickness at the upstream end of the resonator boxes and maintaining the film cooling boundary layer at a substantially constant thickness in a direction downstream from the upstream end of the resonator boxes.

In accordance with other aspects, the method may further comprise providing greater impingement cooling of the combustor liner at the upstream end of the resonator boxes as compared to the downstream end. In a particular aspect, the resonator boxes may further comprise an upstream wall and a downstream wall and providing greater impingement cooling of the combustor liner may comprise forming the resonator boxes such that an upstream wall height is less than a downstream wall height.

In accordance with further aspects, the method may further comprise locating the resonator boxes on the combustor liner such that a flow temperature of hot combustion gases in the interior of the combustor liner is increasing in an upstream to downstream direction along an axial length of the resonator boxes.

In accordance with yet another aspect of the method, the film cooling holes may further comprise a first set of holes having a first axial row spacing X and a second set of holes having a second axial row spacing X'. Each of the first set of holes and the second set of holes is defined by a plurality of rows of holes extending in a circumferential direction, and the second set of holes is formed in the gas turbine combustor liner in a downstream direction relative to the first set of holes. The second axial row spacing X' is greater than the first axial row spacing X. Each of the resonator boxes extend axially over at least a portion of each of the first set of holes and the second set of holes.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
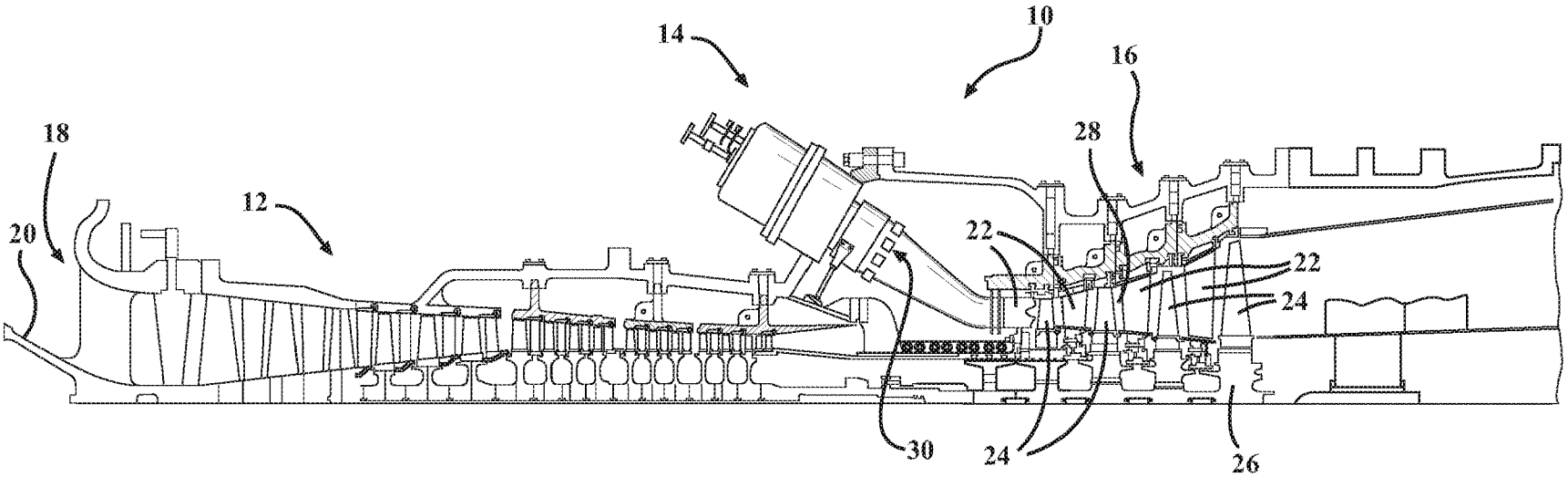
FIG. 1 is a partial cross-sectional view of a gas turbine engine incorporating a resonator structure in accordance with aspects of the invention.

In FIG. 1, a gas turbine engine 10 is illustrated including a compressor section 12, a combustor 14, and a turbine section 16. The compressor section 12 compresses ambient air 18 that enters an inlet 20. The combustor 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flow path 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown). The gas turbine engine 10 further comprises a resonator structure 30 comprising a plurality of resonator boxes 32 (shown in detail in FIGS. 2A and 2B) disposed downstream of the combustion zone of the combustor 14.

Figure 2A:
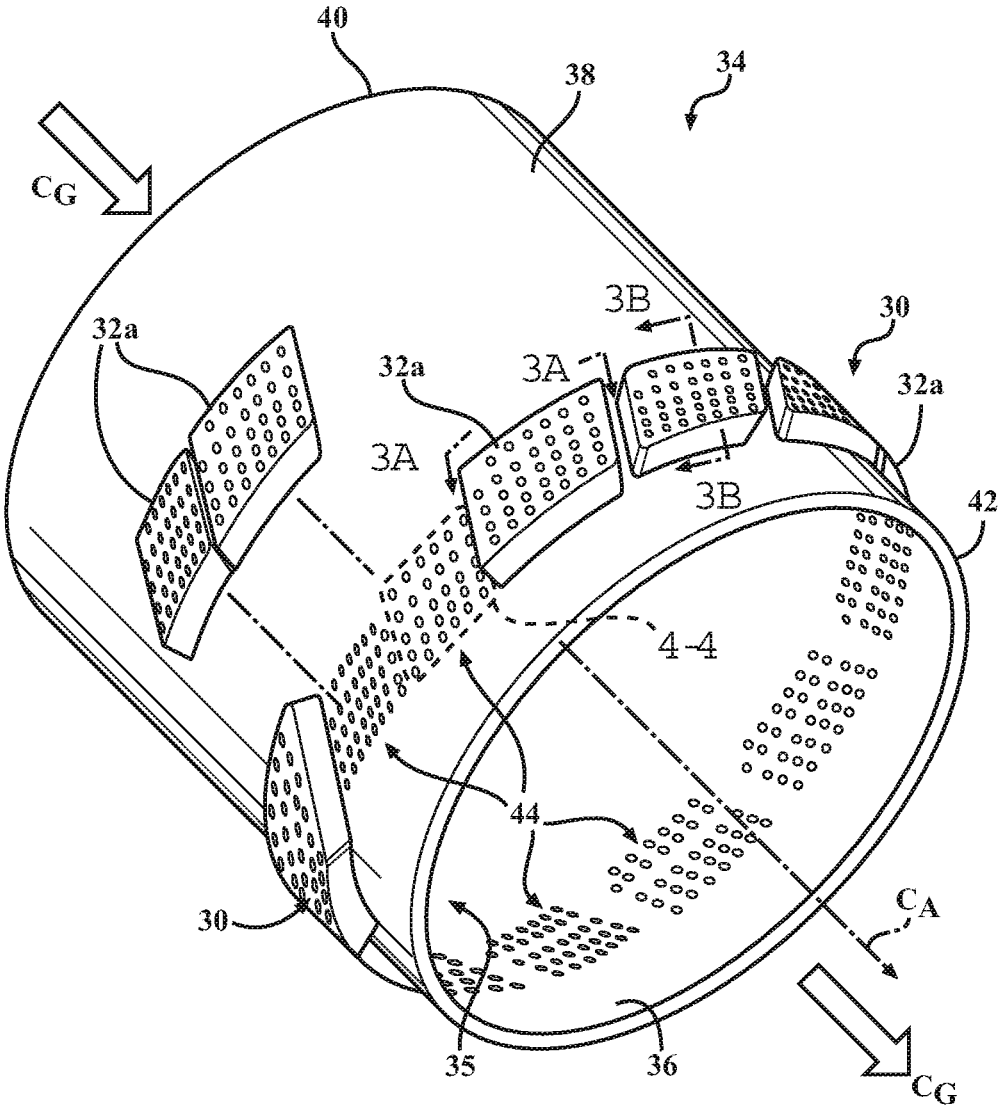
FIG. 2A is a perspective view of a portion of a combustor liner of a gas turbine engine combustor illustrating aspects of the invention, in which a plurality of resonator boxes are affixed to the liner, with two resonator boxes removed to illustrate the underlying film cooling holes.
Figure 2B:
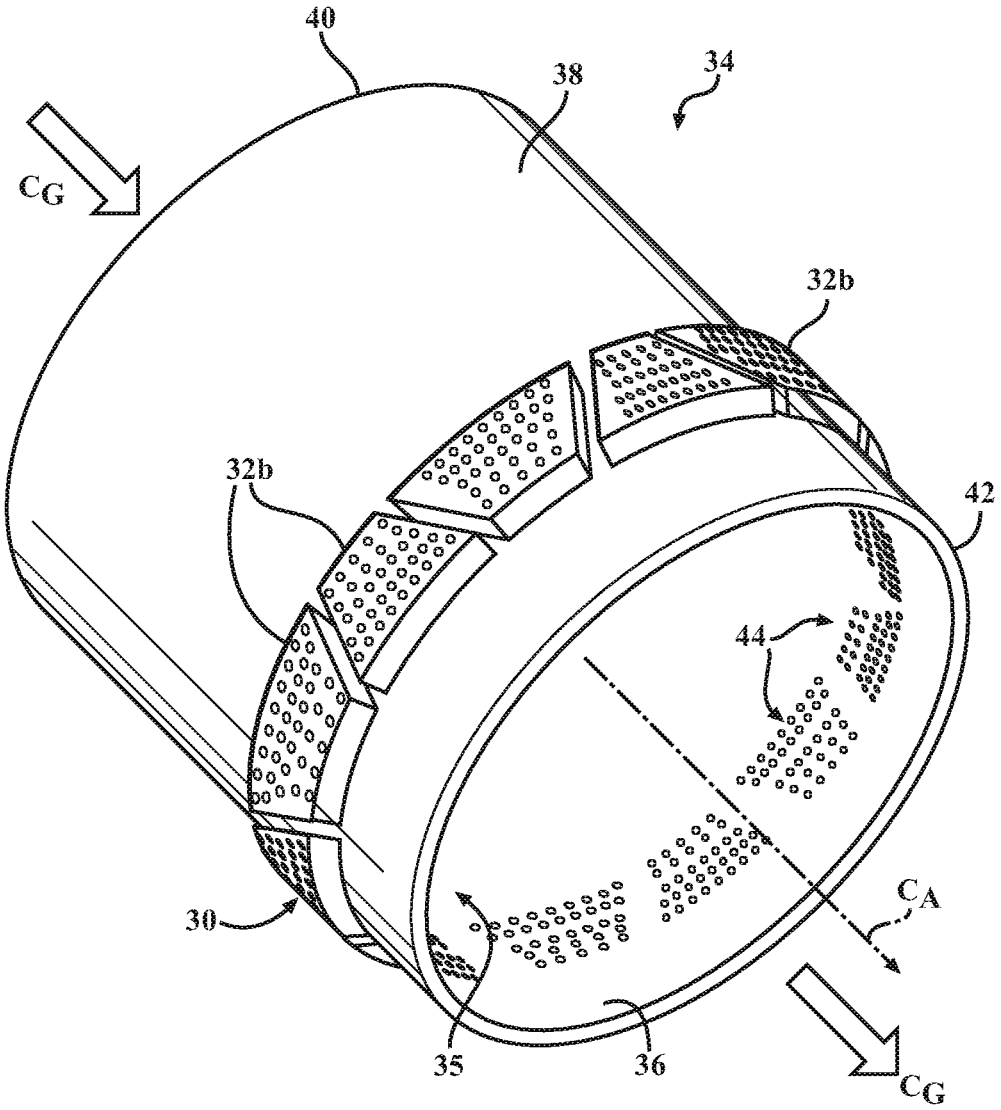
FIG. 2B is a perspective view of a portion of a combustor liner of a gas turbine engine combustor illustrating other aspects of the invention, in which a plurality of resonator boxes are affixed to the liner.

Referring to FIGS. 2A and 2B, a portion of the combustor 14 from FIG. 1 comprising a combustor liner 34 and a resonator structure 30 will be described. The combustor liner 34 has a central axis $C_A$ and comprises an inner surface 36, an outer surface 38, an upstream end 40, and a downstream end 42. The combustor liner 34 may surround a combustion zone 35, with hot combustion gases $C_G$ flowing through an interior of the combustor liner 34 at a substantially constant velocity. A flow of cooling air (not shown) is supplied to the outer surface 38. As used throughout, the terms "circumferential," "axial," "inner/radially inner" and "outer/radially outer" are used with reference to central axis $C_A$ of the combustor liner 34, and the terms "upstream" and "downstream" are used with reference to a flow of hot combustion gases $C_G$. The combustor liner 34 may comprise any suitable cross-sectional shape, such as the substantially circular cross-sectional shape depicted in FIGS. 2A and 2B, as well as oval or rectangular. In addition, the combustor liner 34 may transition between different shapes, such as, for example from a generally circular cross-sectional shape to a generally rectangular cross-sectional shape.

The resonator structure 30 comprises a plurality of resonator boxes 32*a*, 32*b* that are affixed to the outer surface of the combustor liner 34 at a downstream end 42. The resonator boxes 32*a*, 32*b* may be distributed circumferentially about the outer surface 38 of the combustor liner 34 and as shown in FIGS. 2A and 2B, may be uniformly or evenly spaced about the combustor liner 34. The resonator boxes 32*a*, 32*b* may comprise a variety of suitable shapes, such as the rectangular resonator boxes 32*a* depicted in FIG. 2A and the trapezoid-shaped resonator boxes 32*b* in FIG. 2B. As seen most clearly in FIG. 2A, the resonator boxes 32*a*, 32*b* enclose a portion of the outer surface 38 of the combustor liner 34, which is indicated by dashed lines enclosing section 4-4. A portion of the surface area enclosed under each resonator box 32*a*, 32*b* further comprises a plurality of film cooling holes 44 extending through a thickness of the combustor liner 34 from the outer surface 38 to the inner surface 36. The film cooling holes 44 extend circumferentially about the combustor liner 34.

Figure 3A:
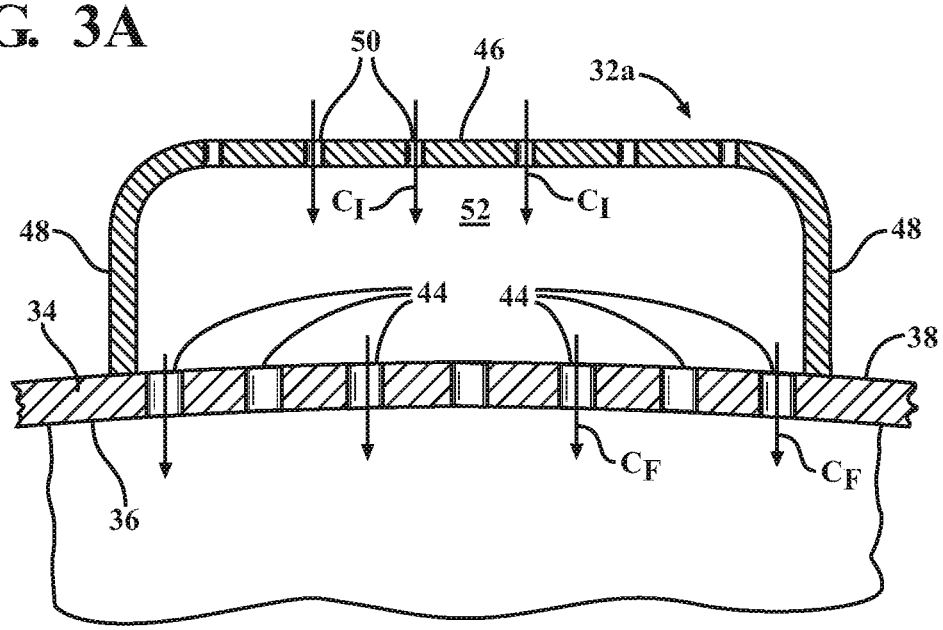
FIG. 3A is an enlarged cross-sectional view of a resonator box illustrated in FIG. 2A taken along line 3A-3A.
Figure 3B:
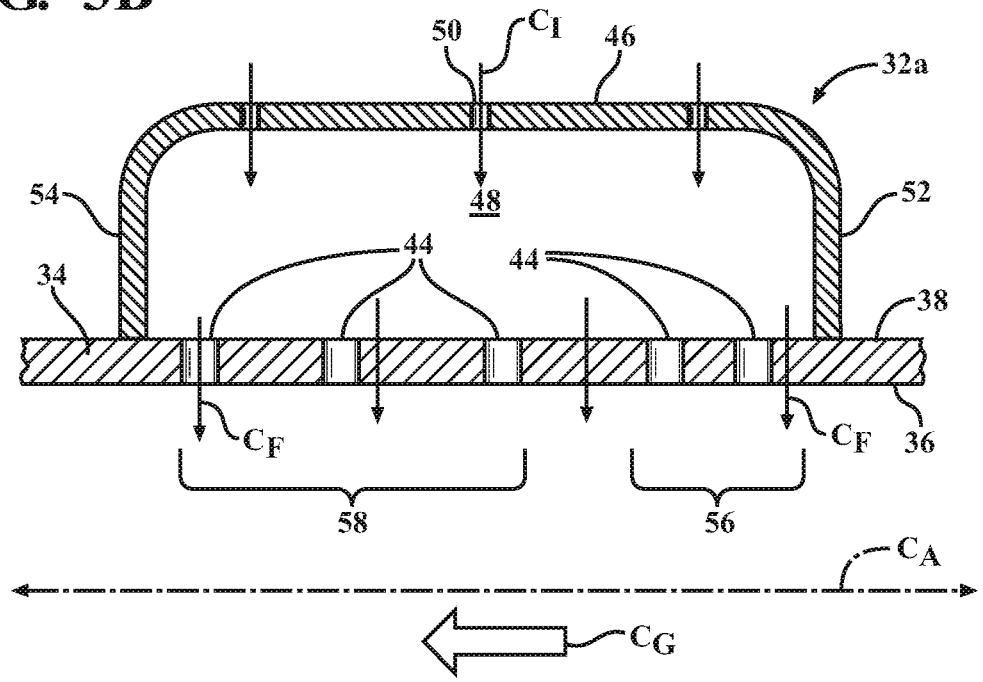
FIG. 3B is an enlarged cross-sectional view of a resonator box illustrated in FIG. 2A taken along line 3B-3B.
Figure 3C:
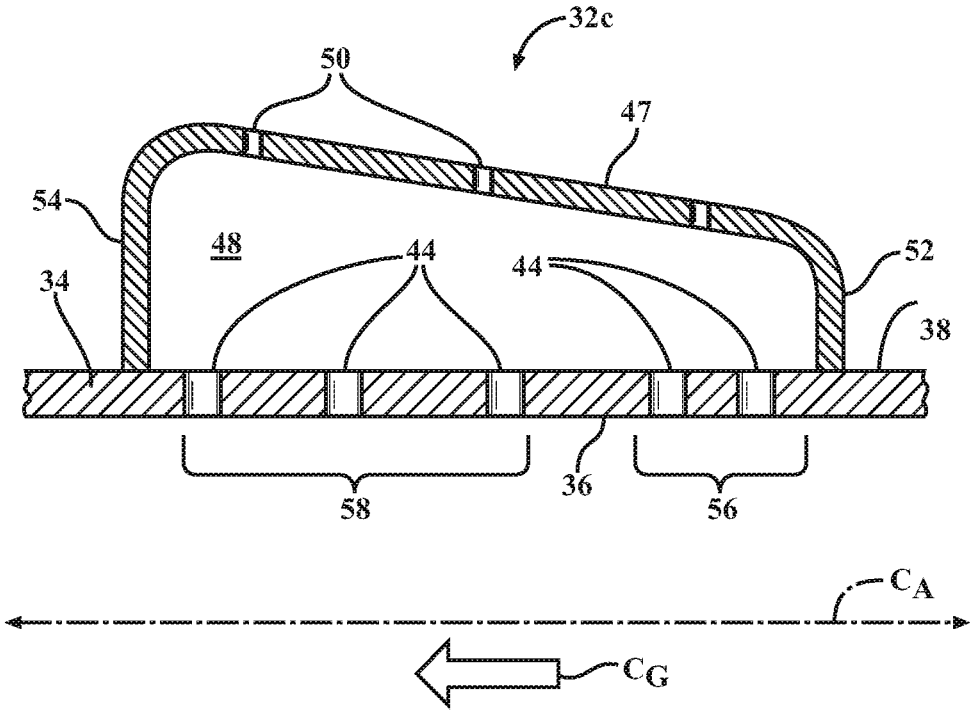
FIG. 3C is an enlarged cross-sectional view of another exemplary resonator box.

FIGS. 3A-3C illustrate various embodiments of the resonator boxes 32*a*, 32*c* and film cooling holes 44 in more detail. FIG. 3A is a cross-sectional view of a resonator box 32*a* illustrated in FIG. 2A taken along line 3A-3A, which is substantially perpendicular to central axis $C_A$. FIG. 3B is a cross-sectional view of the resonator box 32*a* illustrated in FIG. 2A taken along line 3B-3B, which is substantially parallel to central axis $C_A$. With reference to FIGS. 3A and 3B, each resonator box 32*a* forms a closed structure comprising a radially outer surface 46, lateral walls 48, an upstream wall 52, and a downstream wall 54. A plurality of impingement holes 50 may be located, for example, in the radially outer surface 46 of the resonator boxes 32*a*. The impingement holes 50 are configured to introduce an impingement cooling airflow $C_I$ into an interior of the resonator boxes 32*a* where it impinges on the hot outer surface 38 of the combustion liner 34. The impingement holes 50 may comprise any suitable cross-sectional size and shape, including circular and oval.

As shown in FIGS. 3A and 3B, the lateral walls 48, the upstream wall 52, and the downstream wall 54 may be substantially perpendicular to the radially outer surface 46 of the resonator box 32*a* and to the outer surface 38 of the combustor liner 34. In other embodiments (not shown), one or more of the lateral walls 48, the upstream wall 52, and the downstream wall 54 may be, for example, inclined inward or otherwise be non-perpendicular to the radially outer surface 46 and/or the outer surface 38. In addition, one or more of the intersections of the lateral walls 48, the upstream wall 52, and the downstream wall 54 with the radially outer surface 46 and the outer surface 38 may comprise about a 90 degree angle as shown in FIGS. 3A and 3B. In other embodiments (not shown), one or more of the intersections may be curved or rounded.

In some embodiments, the resonator box 32*a* may comprise a substantially symmetrical axial cross-sectional shape as shown, for example, in FIG. 3B. As shown in FIG. 3C, the resonator box 32*c* may also comprise an asymmetrical cross-sectional shape in an axial direction with respect to central axis $C_A$ of the combustor liner 34. For example, the upstream wall 52 in one axially asymmetric embodiment of the resonator box 32*c* may be shorter in height than the downstream wall 54 such that the radially outer surface 47 is inclined upward in an axial direction between the upstream wall 52 and downstream wall 54. In some embodiments, the height of the upstream wall 52 may be approximately half the height of the downstream wall 54 as illustrated in FIG. 3C.

As shown in FIG. 2A, each resonator box 32*a* encloses a portion of the outer surface 38 of the combustor liner 34, with an enclosed surface area (indicated by dashed lines enclosing section 4-4 in FIG. 2A) being defined by a length of the lateral, upstream, and downstream walls 48, 52, 54. With reference to FIGS. 3A, 3B, and 3C, an internal volume of each resonator box 32*a-c* is further defined by a height of the lateral, upstream, and downstream walls 48, 52, 54. Regardless of cross-sectional shape, resonator boxes 32*a-c* enclosing the same enclosed surface area may possess substantially the same internal volume.

Referring to FIGS. 3A-3C, the portion of the combustor liner 34 underlying the resonator boxes 32*a-c* comprises a plurality of film cooling holes 44 extending through the outer surface 38 of the combustor liner to the inner surface 36. As illustrated in FIGS. 3A and 3B, the impingement cooling airflow $C_I$ enters the interior of the resonator box 32*a*, 32*b* via the impingement holes 50, and in some embodiments, the impingement holes 50 may be offset, axially and/or circumferentially, from the film cooling holes 44 to improve impingement cooling of the combustor liner 34. The interior of the resonator box 32*a*, 32*b* is in fluid communication with the interior of the combustion liner 34 via the film cooling holes 44, which allow a film cooling airflow $C_F$ to enter the interior of the combustor liner 34. In the embodiments shown in FIGS. 3A-3C, an axis of the film cooling holes 44 is substantially perpendicular i.e. approximately 90 degrees relative to the inner and outer surfaces 36, 38 and to the central axis $C_A$ of the combustor liner 34. In other embodiments, the axis of the film cooling holes 44 may comprise an inclination angle of between about 70 degrees up to 90 degrees. Generally, if the film cooling holes 44 comprise an inclination angle of less than about 90 degrees, the length of the film cooling hole 44 is increased, which may increase cooling of the combustor liner 34, but resonator structure 30 performance may decrease with a shallower angle. It may also be understood that the film cooling holes 44 further define acoustic passages providing acoustic communication between the interior of the resonator boxes 32*a-c* and the interior of the combustor liner 34 for damping undesirable acoustics in the interior of the combustor liner 34.

Figure 4:
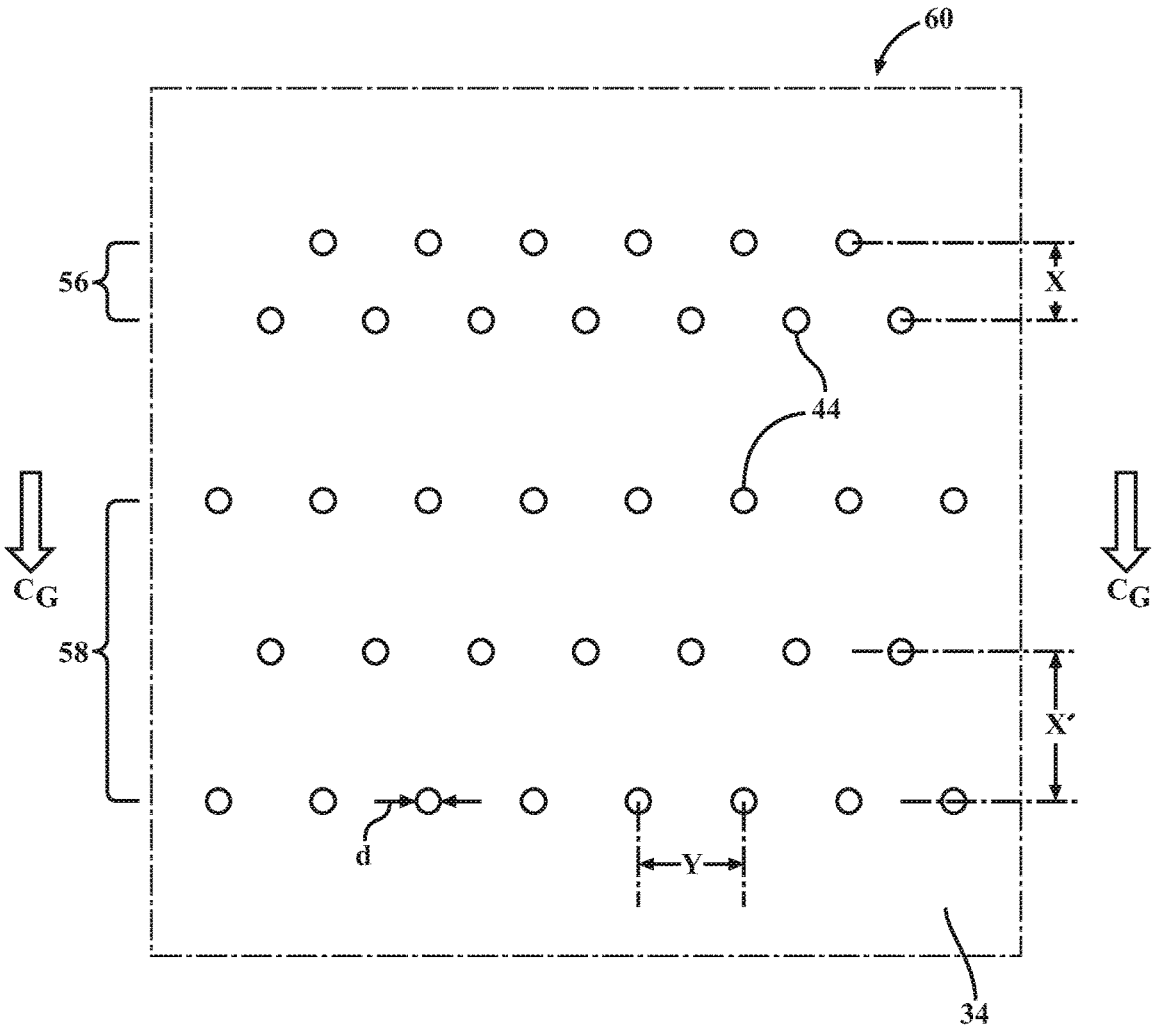
FIG. 4 is an enlarged top view of section 4-4 from FIG. 2A.

Referring to FIGS. 2A, 3B, and 4, a film cooled section 60 underlying one resonator box, which is indicated by dashed lines enclosing section 4-4 in FIG. 2A, will be described in detail. The film cooled section 60 comprises a plurality of film cooling holes 44 that further comprise a first set of holes 56 and a second set of holes 58, with the second set of holes 58 being located downstream of the first set of holes 56. As used throughout, the phrase "set of holes" is defined as two or more rows of film cooling holes extending in a circumferential direction about the combustor liner 34. Each resonator box 32*a*, 32*b* extends axially along the combustor liner 34 such that the film cooled section 60 encompasses at least a portion of each of the first set of holes 56 and the second set of holes 58. The film cooling holes 44 may comprise any suitable shape and size. For example, the film cooling holes 44 may be substantially circular as show in FIG. 4, or they may be oval, triangular, or other suitable shape. In the exemplary embodiments shown in FIGS. 3B and 4, the first set of holes 56 comprises two rows of holes, but other embodiments may comprise three or more rows of holes. Likewise, the second set of holes 58 is depicted as comprising three rows of holes but may comprise two rows of holes, as well as four or more rows of holes.

Referring to FIG. 4, X is the axial row spacing between adjacent rows of holes, and Y is the circumferential hole spacing between adjacent holes within the same row. As best seen in FIGS. 3B, 3C, and 4, the axial row spacing X' of the second set of holes 58 is greater than the axial row spacing X of the first set of holes 56. The axial row spacing and circumferential hole spacing can be described in dimensionless terms. Specifically, a dimensionless first axial row spacing, $X_0$, can be described as X/d, where d is the diameter of the holes. Similarly, a dimensionless second axial row spacing, $X_0'$, can be described as $X_0'$=X'/d. Also, a dimensionless circumferential hole spacing, $Y_0$, can be described as Y/d In some embodiments, $X_0$ is greater than or equal to about 3 and is less than 10, and $X_0'$ is between about 3 and 10.

In some embodiments, the resonator boxes 32*a*, 32*b* may be located toward a downstream end of the main combustion zone 35 of the combustor 14. In other embodiments such as those shown in FIGS. 2A and 2B, the resonator boxes 32*a*, 32*b* may be axially aligned with the combustion zone 35 such that a flow temperature of the hot combustion gases $C_G$, and thus the temperature of the combustor liner 34, are increasing in an upstream to downstream direction due to ongoing combustion reactions.

As shown for example, in FIGS. 3B, 3C, and 4, by increasing the density of the film cooling holes 44 near the upstream wall 52 of the resonator boxes 32*a*, 32*c*, the supply of cooling air is increased, improving film effectiveness at the starting edge of the film cooled section and providing a more uniform temperature profile along an axial length of the resonator boxes 32*a*, 32*c*. This arrangement of film cooling holes 44 may avoid the decreased and/or inconsistent film effectiveness often observed with uniformly spaced holes, in which it has been observed that the temperature can be substantially higher at the upstream portion of the resonator boxes before the film cooling reaches a maximum effectiveness. A more uniform temperature profile along the axial length of the resonator boxes 32*a*, 32*c*, as provided by the present invention, may reduce thermal gradients and therefore increase the low-cycle fatigue life of the combustor liner 34. An improved film effectiveness, along with the more uniform temperature profile, may, in turn, require less cooling air to achieve the same level of cooling as conventional, uniformly spaced film cooling holes, leaving a greater supply of air for the primary head-end reaction and potentially lowering NOx emissions.

As described herein, a tighter axial row spacing at the upstream end of the film cooled section may be paired with a resonator box comprising an asymmetrical cross-sectional shape to achieve improved cooling of the combustor liner and increased film effectiveness. For example, in axially asymmetric embodiments such as the resonator box 32*c* depicted in FIG. 3C, the upstream wall 52 of the resonator box 32*c* is shorter in height than the downstream wall 54, decreasing the distance between the radially outer surface 47 of the resonator box 32*c* and the outer surface 38 of the combustor liner 34. This decreased distance may increase the amount of impingement cooling of the combustor liner 34 near the upstream wall 52 and may further improve cooling effectiveness along the axial length of the film cooled section.

In further embodiments (not shown), a combustor liner comprising a first and a second set of holes may further comprise one or more additional sets of film cooling holes. These additional sets of film cooling holes may be located downstream of the second set of holes and may comprise an additional axial row spacing X" (not shown). In other embodiments of the invention (also not shown), the circumferential hole spacing Y may be varied in one or more rows of holes or in one or more areas of the film cooled section to provide additional cooling for localized areas. The rate of heat buildup and dissipation along the combustor liner will determine the circumferential hole spacing Y, as well as the axial row spacing X" of the additional set(s) of film cooling holes, both of which may be increased or decreased relative to the spacing of the first and second sets of holes as needed to achieve the desired amount of film cooling airflow. In some embodiments, the additional axial row spacing X" is greater than the axial row spacing X' of the second set of holes. For example, some embodiments may comprise additional sets of film cooling holes in which the additional row spacing X" becomes progressively larger in an upstream to downstream direction. In other embodiments, the additional row spacing X" may be less than the axial row spacing of the second set of holes X'.

Figure 5A:
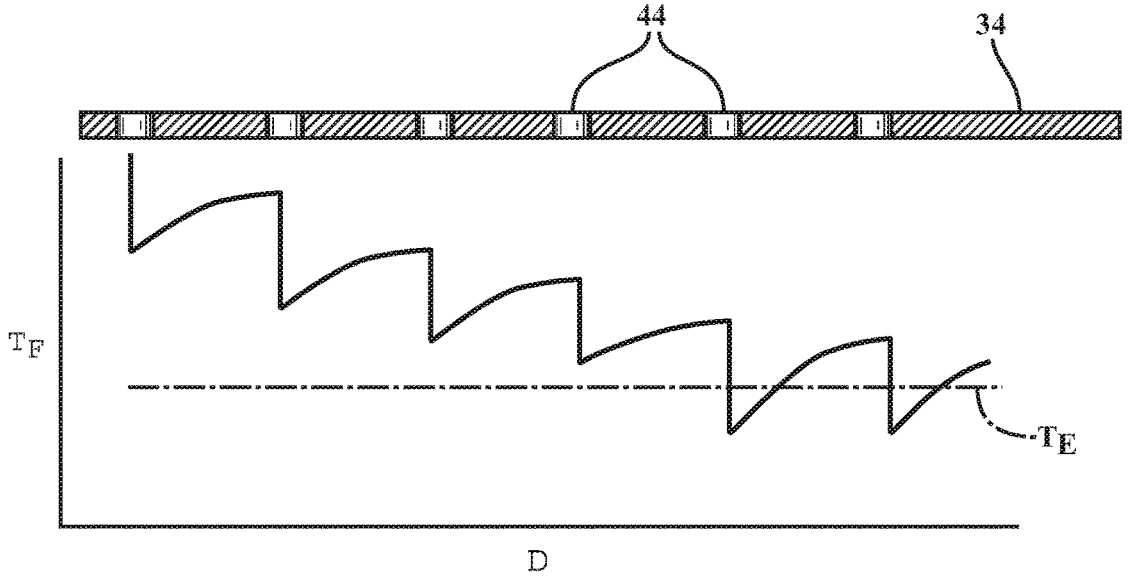
FIGS. 5A and B are exemplary graphs illustrating film cooling effectiveness according to aspects of the invention.
Figure 5B:
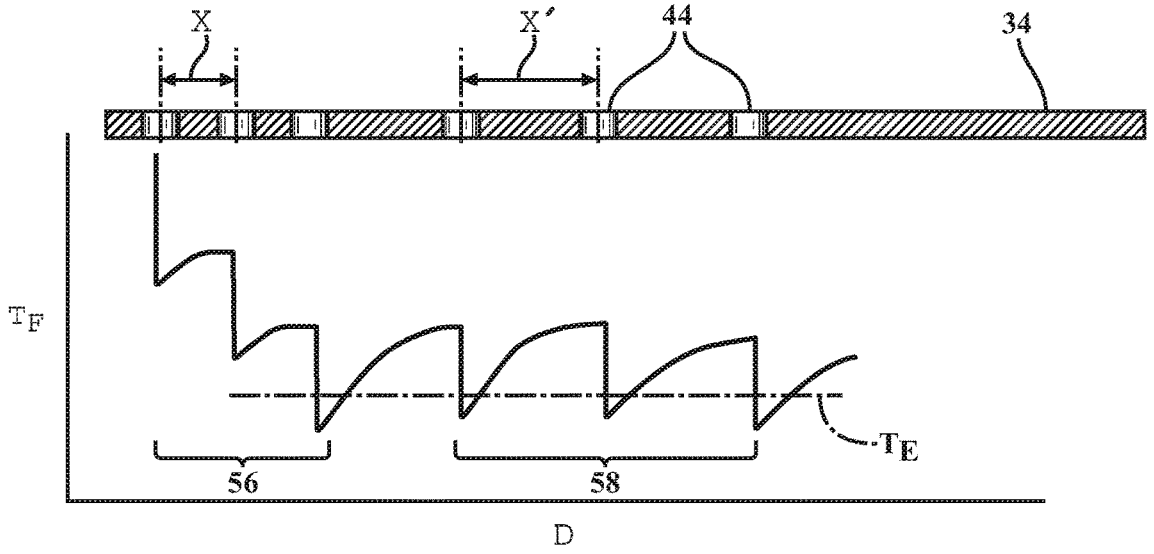

FIGS. 5A and B are exemplary illustrations of film cooling effectiveness as a function of the film temperature $T_F$ and the axial distance D along two embodiments of a film cooled section comprising an enclosed surface area beneath a resonator box. An axial cross-section of a portion of the combustor liner 34 comprising a plurality of film cooling holes 44 is depicted above each graph. The graph in FIG. 5A illustrates film cooling effectiveness in a conventional film cooled section with six rows of film cooling holes 44 with a substantially uniform axial row spacing. The graph in FIG. 5B illustrates film cooling effectiveness in a film cooled section with six rows of film cooling holes 44 according to the present invention. The first set of holes 56 in the graph in FIG. 5B comprises three rows of holes at the upstream end of the film cooled section and has a smaller axial row spacing X as compared to the second set of holes 58, which comprise three rows of holes located downstream of the first set of holes 56 and has axial row spacing X'.

As seen in both graphs, each sequential row of film cooling holes 44 achieves a decrease in $T_F$, followed by a gradual increase in $T_F$ downstream of each row of holes before reaching an equilibrium temperature $T_E$. The effectiveness of the film cooling in the graph shown in FIG. 5A increases incrementally over the axial length of the enclosed surface area before reaching $T_E$, which can result in a thermal gradient along the combustor liner 34 in which a temperature at a mid-section of the film cooled section e.g. between the third and fourth rows of film cooling holes may still be substantially higher than a temperature at a downstream location, for example adjacent to the downstream wall 54 as shown in FIGS. 3B and 3C. In comparison, as seen in the graph depicted in FIG. 5B, the tighter axial row spacing X of the first set of holes 56 achieves a more rapid decrease in $T_F$ and allows the film cooled section to more rapidly reach $T_E$, reducing the thermal gradient and achieving a more uniform temperature profile along the axial length of the enclosed surface area. The axial row spacing of the second set of holes 58 in the graph in FIG. 5B may be designed to maintain $T_F$ at or near $T_E$.

The present invention further includes methods for providing film cooling to a combustor liner and for improving film effectiveness. For illustration purposes, reference is made herein to the components of FIGS. 2A, 2B, 3A-3C, and/or 4, but those of skill in the art will understand that the presently disclosed method may be implemented with other suitable components and configurations. The method begins with providing a combustor liner with a plurality of film cooling holes through a thickness of the liner, such as the combustor liner 34 and film cooling holes 44 depicted in any one of FIGS. 2A, 2B, 3B, and 3C. The combustor liner 34 further comprises a plurality of resonator boxes 32*a-c* that are affixed to an outer surface 38 of the combustor liner 34 and extend axially over at least a portion of the film cooling holes 44.

In the next step, a cooling airflow is supplied to the combustor liner 34. At least a portion of the cooling airflow comprises an impingement cooling airflow $C_I$ that enters the resonator boxes 32*a*, 32*b* via the impingement holes 50, providing impingement cooling of the combustor liner 34 as seen in FIGS. 3A and 3B. The cooling airflow $C_F$ then flows from the resonator boxes 32*a*, 32*b* into the interior of the combustor liner 34 such that the airflow through the combustor liner 34 is greatest at the upstream end of the resonator boxes 32*a*, 32*b*. As shown in FIGS. 3B, 3C, and 4, the increased airflow at the upstream end of the resonator box 32*b*, 32*c* may be accomplished, for example, by a combustor liner 34 having a first set of holes 56 that are more tightly grouped at the upstream end of the resonator box 32*b*, 32*c* as compared to a second set of holes 58 located downstream of the first set of holes 56. The axial row spacing X' of the second set of holes 58 is greater than the axial row spacing X of the first set of holes 56. Each resonator box 32*b*, 32*c* extends axially over at least a portion of each of the first set of holes 56 and the second set of holes 58. In this manner, a film cooling boundary layer of maximum thickness may be created at the upstream end of the resonator boxes 32*b*, 32*c*, and a film cooling boundary layer of substantially constant thickness may be maintained in a direction downstream from the upstream end of the resonator boxes 32*b*, 32*c*, for example, as depicted in the graph in FIG. 5B.

In some embodiments of the method, greater impingement cooling of the combustor liner may be provided at the upstream end of the resonator boxes as compared to the downstream end. This increased amount of impingement cooling may be achieved, for example, by providing a resonator box comprising an asymmetrical cross-sectional shape in an axial direction with respect to the central axis $C_A$ of the combustor liner (see, for example, FIG. 3C). In some embodiments, the upstream wall of the resonator box may be shorter in height than the downstream wall such that the radially outer surface is inclined upward in an axial direction between the upstream and downstream walls. In some embodiments, the height of the upstream wall may be approximately half the height of the downstream wall.

In other embodiments of the method, the resonator boxes may be located on the combustor liner at an axial location where a flow temperature of the hot combustion gases in the interior of the combustor liner may be increasing in an upstream to downstream direction along an axial length of the resonator boxes.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine combustor liner comprising:

an outer surface and an inner surface, the outer surface being exposed to a cooling airflow and the inner surface being exposed to hot combustion gases;

a plurality of film cooling holes through a thickness of the gas turbine combustor liner, the film cooling holes extending circumferentially around the gas turbine combustor liner, wherein the film cooling holes comprise:

a first set of holes having a first axial row spacing X, the first set of holes being defined by a first plurality of rows of holes extending in a circumferential direction; and a second set of holes having a second axial row spacing X', the second set of holes being defined by a second plurality of rows of holes extending in a circumferential direction, wherein the second set of holes is formed in the gas turbine combustor liner in a downstream direction relative to the first set of holes, the second axial row spacing X' being greater than the first axial row spacing X; and a plurality of resonator boxes affixed to the outer surface of the gas turbine combustor liner; and wherein each of the resonator boxes extend axially over at least a portion of each of the first set of holes and the second set of holes.

2. The gas turbine combustor liner of claim 1 wherein an axis of the film cooling holes is substantially perpendicular to the outer surface and the inner surface of the gas turbine combustor liner.

3. The gas turbine combustor liner of claim 1 wherein a dimensionless first axial row spacing, $X_0=X/d$, of the first set of holes is greater than or equal to about 3 and less than 10, where d is the diameter of the holes, and wherein the second axial row spacing $X_0'=X'/d$, of the second set of holes is between about 3 and 10.

4. The gas turbine combustor liner of claim 1 wherein the resonator boxes further comprise a plurality of impingement holes configured to introduce at least a portion of the cooling airflow into the resonator boxes.

5. The gas turbine combustor liner of claim 1 wherein the resonator boxes further comprise an upstream wall and a downstream wall, an upstream wall height being less than a downstream wall height.

6. The gas turbine combustor liner of claim 1 wherein the resonator boxes are affixed to a location of the gas turbine combustor liner wherein a flow temperature of the hot combustion gases is increasing in a downstream direction.

7. The gas turbine combustor liner of claim 1 wherein the first set of holes further comprises a first circumferential hole spacing and the second set of holes further comprises a second circumferential hole spacing, the first circumferential hole spacing Y being different than the second circumferential hole spacing.

8. A turbine engine assembly comprising:

a turbine engine having a compressor section, a combustor comprising a combustor liner, and a turbine section, wherein the combustor liner comprises:

a plurality of film cooling holes extending circumferentially around the combustor liner and extending through a thickness of the combustor liner, wherein the film cooling holes comprise a first set of holes having a first axial row spacing X and a second set of holes having a second axial row spacing X', the first set of holes and the second set of holes each being defined by a plurality of rows of holes extending in a circumferential direction, wherein the second set of holes is located in a downstream direction relative to the first set of holes, the second axial row spacing X' being greater than the first axial row spacing X; and a plurality of resonator boxes affixed to and located circumferentially about an outer surface of the combustor liner, wherein each of the resonator boxes extend axially over at least a portion of each of the first set of holes and the second set of holes, the resonator boxes further comprising a plurality of impingement holes configured to introduce a cooling airflow into the resonator boxes.

9. The turbine engine assembly of claim 8 wherein the impingement holes are offset from the film cooling holes.

10. The turbine engine assembly of claim 8 wherein an interior of each resonator box is in fluid communication with an interior of the combustor.

11. The turbine engine assembly of claim 8 wherein the resonator boxes further comprise an upstream wall and a downstream wall, an upstream wall height being less than a downstream wall height.

12. A turbine engine assembly comprising:

a turbine engine having a compressor section, a combustor comprising a combustor liner, and a turbine section, wherein the combustor liner comprises:

a plurality of film cooling holes extending circumferentially around the combustor liner and extending through a thickness of the combustor liner, wherein the film cooling holes comprise a first set of holes having a first axial row spacing X and a second set of holes having a second axial row spacing X', the first set of holes and the second set of holes each being defined by a plurality of rows of holes extending in a circumferential direction, wherein the second set of holes is located in a downstream direction relative to the first set of holes, the second axial row spacing X' being greater than the first axial row spacing X; and a plurality of resonator boxes affixed to and located circumferentially about an outer surface of the combustor liner, wherein each of the resonator boxes extend axially over at least a portion of each of the first set of holes and the second set of holes, the resonator boxes further comprising a plurality of impingement holes configured to introduce a cooling airflow into the resonator boxes; and wherein the film cooling holes further comprise a first set of holes having a first axial row spacing X and a second set of holes having a second axial row spacing X', each of the first set of holes and the second set of holes being defined by a plurality of rows of holes extending in a circumferential direction, wherein the second set of holes is formed in the gas turbine combustor liner in a downstream direction relative to the first set of holes, the second axial row spacing X' being greater than the first axial row spacing X, wherein each of the resonator boxes extend axially over at least a portion of each of the first set of holes and the second set of holes.

13. The method of claim 12 further comprising providing a film cooling boundary layer of maximum thickness at the upstream end of the resonator boxes and maintaining the film cooling boundary layer at a substantially constant thickness in a direction downstream from the upstream end of the resonator boxes.

14. The method of claim 12 further comprising providing greater impingement cooling of the combustor liner at the upstream end of the resonator boxes as compared to the downstream end.

15. The method of claim 14 wherein the resonator boxes further comprise an upstream wall and a downstream wall and wherein providing greater impingement cooling of the combustor liner comprises forming the resonator boxes such that an upstream wall height is less than a downstream wall height.

16. The method of claim 12 further comprising locating the resonator boxes on the combustor liner such that a flow temperature of hot combustion gases in the interior of the combustor liner is increasing in an upstream to downstream direction along an axial length of the resonator boxes.

* * * * *